US006269884B1

(12) United States Patent
Averhoff

(10) Patent No.: US 6,269,884 B1
(45) **Date of Patent: *Aug. 7, 2001**

(54) GAS DISPLACED CHAMBER LIFT SYSTEM WITH CLOSED LOOP/MULTI-STAGE VENTS

(75) Inventor: Jon R. Averhoff, Houston, TX (US)

(73) Assignee: Valence Operating Company, Kingwood, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/405,052

(22) Filed: Sep. 27, 1999

Related U.S. Application Data

(63) Continuation-in-part of application No. 09/339,482, filed on Jun. 24, 1999, which is a continuation-in-part of application No. 09/201,017, filed on Nov. 30, 1998.

(51) Int. Cl.[7] ..... E21B 43/00

(52) U.S. Cl. ..... 166/372; 166/105

(58) Field of Search ..... 166/372, 105, 166/105.6; 92/37, 38; 60/370; 417/120

(56) References Cited

U.S. PATENT DOCUMENTS

| | | | |
|---|---|---|---|
| 3,617,152 | | 11/1971 | Cummings . |
| 4,589,494 | | 5/1986 | Sakoda . |
| 4,708,595 | | 11/1987 | Maloney et al. . |
| 5,141,412 | | 8/1992 | Meinz . |
| 5,211,242 | | 5/1993 | Coleman et al. . |
| 5,217,067 | | 6/1993 | Landry et al. . |
| 5,407,010 | | 4/1995 | Hershberger . |
| 5,542,472 | | 8/1996 | Pringle et al. . |
| 5,562,161 | | 10/1996 | Hisaw et al. . |
| 5,671,813 | | 9/1997 | Lima . |
| 5,806,598 | | 9/1998 | Amani . |
| 6,021,849 | * | 2/2000 | Averhoff ..... 166/372 |

FOREIGN PATENT DOCUMENTS

| | | |
|---|---|---|
| 23 64 737 | 7/1975 | (DE) . |
| 570697 | 8/1977 | (SU) . |
| 1204-700-A | 5/1986 | (SU) . |

OTHER PUBLICATIONS

The Technology Of Artificial Lift Methods. vol. 2a pp. 124–132.

Otis Single and Dual–Acting Gas Pumps: To Enhance Artificial Lift Production for Light and Heavy Crude in Shallow and Deep Wells. Otis Engineering sales brochure.

* cited by examiner

*Primary Examiner*—David Bagnell
*Assistant Examiner*—John Kreck
(74) *Attorney, Agent, or Firm*—Harrison & Egbert

(57) ABSTRACT

An artificial lift system for use in a well bore including at least one chamber having an inlet and an outlet, a power gas string in valved communication with the chamber, a liquid string in valved communication with the outlet of the chamber, at least one vent in valved communication with the chamber and adapted to pass a vented gas from the chamber, a compressor connected to the power gas string and adapted to pass a pressurized gas into the power gas string, and a valve connected to the power gas string and to the chamber. The vent is connected to the compressor and is adapted to pass the vented gas into the compressor. The valve is adapted to selectively allow the pressurized gas to enter the chamber so as to cause a liquid in the chamber to pass through the outlet of the chamber and into the liquid string. A first vent is in valved communication with the chamber and is connected to a stage of the compressor. A second vent is in valved communication with the chamber and is adapted so as to pass vented gas into the annulus of the well bore. The chamber is a multi-stage compressor. The first vent passes vented gas into a later stage of the multi-stage compressor.

15 Claims, 4 Drawing Sheets

GAS DISPLACED CHAMBER LIFT SYSTEM WITH CLOSED LOOP/MULTI-STAGE VENTS

RELATED APPLICATIONS

The present application is a continuation-in-part of U.S. application Ser. No. 09/339,482, filed on Jun. 24, 1999, and entitled "Gas Displaced Chamber Lift System Having a Double Chamber", presently pending. U.S. patent application Ser. No. 09/339,482 is a continuation-in-part of U.S. application Ser. No. 09/201,017, filed on Nov. 30, 1998, and entitled "Gas Displaced Chamber Lift System", presently pending.

TECHNICAL FIELD

The present invention relates to artificial lift systems. More particularly, the present invention relates to chamber lift systems which are used so as to deliver oil, water and gas from a well bore to a surface above the well bore. More particularly, the present invention relates to gas-displaced chamber lift systems.

BACKGROUND ART

At the present time, it is common to permit oil and gas wells to flow under their own natural pressure as long as they will do so and then to apply a mechanical reciprocating pump to complete the removal of the liquids. This method, although in general use, is cumbersome and unsatisfactory. Because suction will only raise oil for a distance of some thirty-five feet, it is necessary to have the pump near the bottom of the well so that it can exert pressure instead of suction on the liquids coming out of the well. This involves the use of pump rods of lengths of 5,000 feet or greater. In many instances when the pump plunger or the valves become worn, it is necessary to remove the pump from that depth to replace the worn parts. Furthermore, the collars on the pump rod wear rapidly and all the pump parts do likewise because of the small particles of grit that remain in the liquid and the whole device is mechanically inefficient because of the relatively long pump rods that must be reciprocated to perform the pumping operation.

When the natural flow of liquid from a well has ceased or becomes too slow for economical production, artificial production methods are employed. In many cases, it is advantageous, at least during the first part of the artificial production period, to employ gas lift. Numerous types of equipment for producing liquid by gas lift are available, but they all rely upon the same general principles of operation. In the usual case, dry gas consisting essentially of methane and ethane is forced down the annulus between the tubing and the casing and into the liquid in the tubing. As the liquid in the tubing becomes mixed with gas, the density of the liquid decreases, and eventually the weight of the column of the gasified liquid in the tubing becomes less than the pressure exerted on the body of liquid in the well, and the flow of liquid occurs at the surface. While, in some cases, the dry gas may be introduced through the tubing so as to cause production through the annulus, this is not preferred unless special conditions are present.

One known gas lift technique injects gas into the casing, which has been sealed or packed off at the bottom of the hole relative to the production tubing. A gas lift valve is placed in the production tubing at the production level, and the gas lift valve permits the gas to be injected into or bubbled very slowly into the liquid being produced from the well. This gas then makes the liquid in the production tube somewhat lighter and, hence, the natural formation pressure will be sufficient to push the liquid up and out of the well. This means that the well can be produced at a greater rate. This gas lift technique is known as continuous gas lift.

A further adaptation of this gas lift technique is known as intermittent gas lift. In this technique, rather than letting the gas enter the production tube slowly, the gas is injected into the production tubing very quickly, in short bursts, thereby forming a large slug of liquid in the production tubing above the injected gas bubble. The gas bubble then drives the slug of liquid in the production tubing upwardly. The technique is repeated successively, thereby producing successive slugs of liquid at the wellhead.

Another type of gas lift tool involves a procedure where a string of production tubing extending from the surface to the zone of interest is provided with a number of gas lift valves positioned at spaced intervals along the length of the tubing. Gas is injected from the annulus between the tubing and the well pipe through the gas lift valves and into the tubing for the purpose of forcing liquid upwardly to the surface and ultimately into a flowline that is connected with the production tubing. Gas lift systems for liquid production are quite expensive due to the cumulative expense of the number of gas lift valves that are ordinarily necessary for each well. Moreover, each of the gas lift valves must be preset for operation at differing pressures because of the vertical spacing thereof within the tubing string and because the valves must function in an interrelated manner to achieve lifting of liquid within the tubing string.

In the past, various patents have issued relating to such gas lift systems. For example, U.S. Pat. No. 5,671,813, issued on Sep. 30, 1997 to P. C. Lima describes a method and apparatus for the intermittent production of oil. In this method, two production strings extend downwardly from a wellhead of an oil well to a point adjacent a producing region. The lower ends of the two production strings are connected by a coupling which allows a mechanical interface launched adjacent to the wellhead of one of the production strings to descend along the production string through the coupling and upwardly through the other production string to displace oil from the production strings to a surge tank. High pressure gas is utilized to move the mechanical interface through the production strings and suitable valves are provided for controlling the flow of gas and oil through the production strings.

U.S. Pat. No. 5,562,161, issued on Oct. 8, 1996 to Hisaw et al. describes a method of accelerating production from a well. This method includes the steps of installing a venturi device within the well. A gas is injected within the annulus and introduced into the well. The venturi device creates a zone of low pressure within the well as well as accelerating the velocity of the production fluid so that the inflow from the reservoir is increased.

U.S. Pat. No. 5,407,010, issued on Apr. 18, 1995 to M. D. Herschberger teaches an artificial lift system and method for lifting fluids from an underground formation. This artificial lift system includes a production tubing through which the fluid is carried from the formation to the surface and a pressure reducer, such as a venturi, connected to the production tubing to artificially raise the level of the fluid in the production tubing above the static level associated with the head pressure of the fluid in the formation.

U.S. Pat. No. 5,217,067, issued on Jun. 8, 1993 to Landry et al. describes an apparatus for increasing flow in an oil well which includes an injection valve so as to enable gas to be injected and to cause the oil or other liquid within the well to be lifted to the surface. The valve has a valve body having an inlet at one end and an outlet at the other end which are adapted to be fitted into conventional production oil tubing. A gas injection port opens into the outlet of the valve body and there is at least one gas inlet opening in a side of the valve body. This gas inlet opening is connected to the gas injection port. This enables compressed gas to be sent down the well between the casing and the tubing and injected through the gas injection port and into the flow of oil.

U.S. Pat. No. 5,211,242, issued on May 18, 1993 to Coleman et al. describes a chamber in a well which is connected to two externally separate tubing strings to unload liquid which is applying backpressure against a formation so that the production of fluid from the formation is obstructed. Volumes of the liquid are intermittently collected in the chamber and lifted out of the well through one of the tubing strings in response to high pressure gas injected solely into the chamber through the other tubing string.

U.S. Pat. No. 4,708,595, issued on Nov. 24, 1987 to Maloney et al. describes an intermittent gas-lift apparatus and process of lifting liquids. This apparatus includes a chamber on the downhole end of a production tubing in communication with a sidestring tube. The sidestring tube is in communication with the high pressure gas stored within the casing and above and below a packer. A valve in the sidestring tube permits the entrance of a lifting gas into the chamber to lift the liquids flowing therein to the surface. A surface bleed-down system minimizes the pressure in the production tubing. This increases the pressure differential between the formation and the interior of the casing and lifting chamber during the operation of the apparatus.

German Patent No. 23 64 737, published on Jul. 10, 1975, teaches a compressed air lift pump for deep wells in which the pump has a number of stages one above the other. Liquid is raised by air from the reservoir of one stage to the reservoir of the next. Each stage has two air supply pipes which contain three-way valves operated by an electronic timer to admit and release air alternately.

Soviet Patent No.1204-700-A teaches an intermittent gas lift system for a pump well which includes a tubing, a packer, a substitution chamber and intake valve, lift starter valves and working valves with a seal and a seat over a space connected to the chamber. The rising level of fluid in the chamber raises the float so as to close off ports and thus raise pressure above the diaphragm so as to clear the valve and transfer gas to the chamber. This gas forces the fluid into the tubing and uses a pressure gradient to hold the ports closed. Gas eventually enters the tubing after all fluid has been expelled, thus opening the two ports by lowering the float back down. Gas is removed entirely from the chamber by the incoming fluid.

Soviet Patent No. 570697 teaches an oil production facility including a displacement chamber, two strings of compressor pipes of which one is coupled to the surface drive. The gas from the chamber is recuperated and expanded. When one vessel is empty, fluid is drawn into the displacement chamber. The second vessel pumps oil over into the empty vessel so as to raise its pressure to the point required to drive the hole fluid over into the lifting string to the surface. Once the fluid in the chamber reaches the bottom of the lift string, the motor reverses so as to turn an electric shaft and compress the gas in the first vessel to repeat the process in a second hole.

U.S. Pat. No. 3,617,152, issued on Nov. 2, 1971 to Leslie L. Cummings, discloses a method and apparatus for the artificial lifting of well fluids. In particular, this device utilizes an automatic well pump which utilizes compressed power gas to displace well production fluids from the well bore to the earth surface. Power gas is exhausted from the pump so as to be collected in a chamber at a desired predetermined superatmospheric pressure to reduce the energy required to compress the air. This device utilizes gas assist lifting so as to move the liquid, in stages, to the surface. Also, the device uses the compressed gas, as opposed to the vented gas, for the gas assist.

A publication of Otis Engineering Corporation, dated 1982, and entitled "Otis Single and Dual-Acting Gas Pumps" describes a gas assist system in which the pump displaces a barrel of oil with a barrel of gas volume at a lift depth pressure. When the gas pressures are too low to lift wells by positive displacement, the gas pump can be aligned with gas lift to lift deeper with lower pressures. The gas lift supply comes from the compressor at various stages along the liquid string.

U.S. Pat. No. 5,806,598, issued on Sep. 15, 1998, to M. Amani describes an apparatus for removing fluids from underground wells. This device includes a supply valve having an open supply position to supply gas to the chamber and a closed supply position. The device further includes a vent valve having an open vent position to vent gas from the chamber and a closed vent position. An actuator communicates with a source of pressurized fluid at the surface for actuating the supply and vent valves. The actuator moves the supply valve to the open position and the vent valve to the closed position, and alternately moves the vent valve to the open position and the supply valve to the closed supply position.

A major problem with the aforedescribed artificial lift systems is that they do not work effectively in deep well and sour gas environments. In particular, at depths of greater than 10,000 feet, the temperature range encountered can be approximately 300 degrees Fahrenheit. As such, any mechanical pumping apparatus will not work effectively at such temperatures. At such great depths, the rod pump devices and submersible pump apparatus do not effectively deliver oil and gas to the surface. For example, at such great depths, the pump rod will have an extreme length which cannot be easily reciprocated back and forth. Furthermore, the cost associated with such a lengthy pump rod would not allow for efficient production. The high temperature and pressures encountered at such depth cause submersible pumps and hydraulic pumps to fail quickly.

In those systems in which the intermittent production of "slugs" of oil is utilized, such systems are ineffective at such depths. In each case in which a "slug" of oil is produced, the gas must be relied upon so as to deliver such a slug to the surface. At great depths, this can take a great deal of time so as to produce an economical amount of oil. Furthermore, the pressure and energy required so as to push such a slug to the surface may exceed the value of the actual production.

Production at such a depth is further complicated by situations in which a corrosive sour gas is encountered. This is particularly true in those cases in which oil and gas must be removed from Smackover wells.

U.S. patent application Ser. No. 09/201,017, filed on Nov. 30, 1998, to the present applicant, describes the original form of the gas displaced chamber lift system. After experimentation, study and analysis, it was found that it was important to have a gas displaced chamber lift system that operated in a relatively continuous mode. In the single chamber gas displaced chamber lift system, liquid would accumulate in the single chamber. After sufficient liquid had accumulated in the chamber, then the valve would open so as to cause the pressurized gas to pass through the power gas string with sufficient pressure so as to evacuate the chamber of the liquid and to pass the liquid from the outlet of the chamber into the liquid string. After the liquid would pass to the liquid string, the pressurized gas from the power gas string would be blocked and the remaining gas within the chamber would be vented to the surface. It was found that during the process of evacuating the chamber and during the process of venting the gas, there was a period of time in which production ceased. It was found to be desirable to allow production (i.e. the accumulation of liquid in the chamber) to continue during the evacuation and venting process. As such, a double chamber approach was devised and disclosed in this prior application. Parent patent application Ser. No. 09/201,017 described a double chamber approach in which one of the chambers was stacked on top of the other chamber or in which one chamber was located interior of and in concentric relationship with the other chamber. After experimentation and analysis, it was found that such an arrangement was difficult to configure within the well bore. Additionally, the stacked arrangements could occasionally produce varying quantities of liquid within the respective chambers due to the head pressure within the well.

U.S. patent application Ser. No. 09/339,482, filed on Jun. 24, 1999, to the present Applicant describes a modified form of the gas displaced chamber lift system. After experiment and analysis, it was found that the efficiency of the subject matter of this patent application could be improved by utilizing the vented gases for the purposes of reducing the weight of the liquid in the liquid string. Since the gas displaced chamber lift system would vent the gases from the chamber, it was felt that the vented gases could be put to better use by simply reinfecting such gases into the liquid string. However, because of the pressures within the liquid string, the gas could not be injected, efficiently, into the liquid string when the pressures within the liquid string are too great. Furthermore, U.S. patent application Ser. No. 09/339,482 describes a valving system placed exterior to the liquid string. As such, in order to accommodate both the shifting valve and the liquid string, the shifting valve required a minimal amount of space. Upon further experimentation and analysis, it was found that a better design could be achieved for the placement of the shifting valve within the well bore.

With the afore-described systems of the present inventor, all of the work required for the generation of the pressure in the power gas string must be produced by the compressor. As such, the compressor will take ambient air, and, through the use of multiple stages, elevate such pressure to greater than 5,000 p.s.i. It would be desirable to improve the efficiency of such a multi-stage compressor by introducing the pressurized gas from the downhole vented gas.

It is an object of the present invention to provide an artificial lift system which works effectively at depths of greater than 10,000 feet.

It is a further object of the present invention to provide an artificial lift system which can operate in a high temperature environment at the bottom of the well.

It is another object of the present invention to provide an artificial lift system in which production from the liquid string occurs continuously without the need for transporting a "slug" of oil to the surface.

It is another object of the present invention to provide an artificial lift system which works effectively in highly corrosive sour gas environments.

It is another object of the present invention to provide an artificial lift system which can lift liquid volumes of approximately 500 barrels per day.

It is a further object of the present invention to provide an artificial lift system which can operate in a very "gassy"/high API oil gravity environment.

It is still a further object of the present invention to provide an artificial lift system which can handle saturated brines of greater than 200,000 parts per million.

It is still another object of the present invention to provide a double chamber gas displaced chamber lift system in which at least one chamber is continuously available for the accumulation of liquid therein.

It is a further object of the present invention to provide a double chamber gas displaced chamber lift system in which the chambers can be alternately evacuated and vented without interrupting production capacity.

It is still a further object of the present invention to provide a double chamber gas displaced chamber lift system which is easy to configure and easy to install within the well bore and which is not subject to varying head pressures within the well bore.

It is still a further object of the present invention to provide an artificial lift system which can improve efficiency by reinjecting the vented gas into the liquid string.

It is another object of the present invention to provide an artificial lift system which maximizes the space in the well bore available for the installation of the shifting valve.

It is still a further object of the present invention to provide an artificial lift system whereby the pressurized gas is conserved and reused in an efficient and economical manner.

These and other objects of the present invention will become apparent from a reading of the attached specification and appended claims.

SUMMARY OF THE INVENTION

The present invention is an artificial lift system for use in a well bore that comprises at least one chamber having an inlet and an outlet, a power gas string in valved communication with the chamber, a liquid string in valved communication with the outlet of the chamber, at least one vent in valved communication with the chamber and adapted to pass a vented gas from the chamber, a compressor connected to the power gas string and adapted to pass a pressurized gas into the power gas string and a valve connected to the power gas string and to the chamber. The vent is connected to the compressor and is adapted to pass the vented gas into the compressor. The valve is adapted to selectively allow the pressurized gas to enter the chamber so as to cause a liquid in the chamber to pass through the outlet of the chamber and into the liquid string.

In the present invention, the vent comprises a first vent in valved communication with the chamber and connected to the compressor and a second vent in valved communication with the chamber. The first vent is adapted to pass vented gas of a first pressure range from the chamber and into the compressor. The second vent is adapted to pass vented gas of a second pressure range into the well bore. The first pressure range is greater than the second pressure range.

In the present invention, the compressor is a multi-stage compressor. The vent is connected to one stage of the compressor. In particular the compressor has a first stage, a second stage and a third stage. The third stage is connected to the power gas string. The vent is connected to an inlet of the third stage. The first pressure range includes pressures of greater than 2,500 p.s.i. The second vent is adapted to pass the vented gas of the second pressure range into the annulus of the casing.

The annulus of the casing is connected to an inlet of the first stage such that the vented gas of the second pressure range passes into the compressor. The compressor is adapted to pass pressurized gas of greater than 5,000 p.s.i. into the pressurized gas string.

In the preferred embodiment of the present invention, the chamber comprises a first chamber having an inlet and an outlet, and a second chamber having an inlet and an outlet. The second chamber is arranged in parallel relation to the first chamber. The first chamber is arranged in spaced and separate relationship to the second chamber. The first chamber has an approximately equal volume as the second chamber. The first chamber has a top end aligned in a horizontal plane with a top of the second chamber. The first chamber has a bottom end aligned in a horizontal plane with a bottom of the second chamber. The valve is movable between a first position and a second position. The first position allows pressurized gas from the power gas string into one of the first and second chambers while blocking pressurized gas from entering another of the first and second chambers. The second position allows pressurized gas into another of the first and second chambers while blocking pressurized gas from entering the other chamber. The valve is also adapted to switch between the first and second vents relative to a pressure of the vented gas.

DETAILED DESCRIPTION OF THE PRESENT INVENTION

Figure 1:
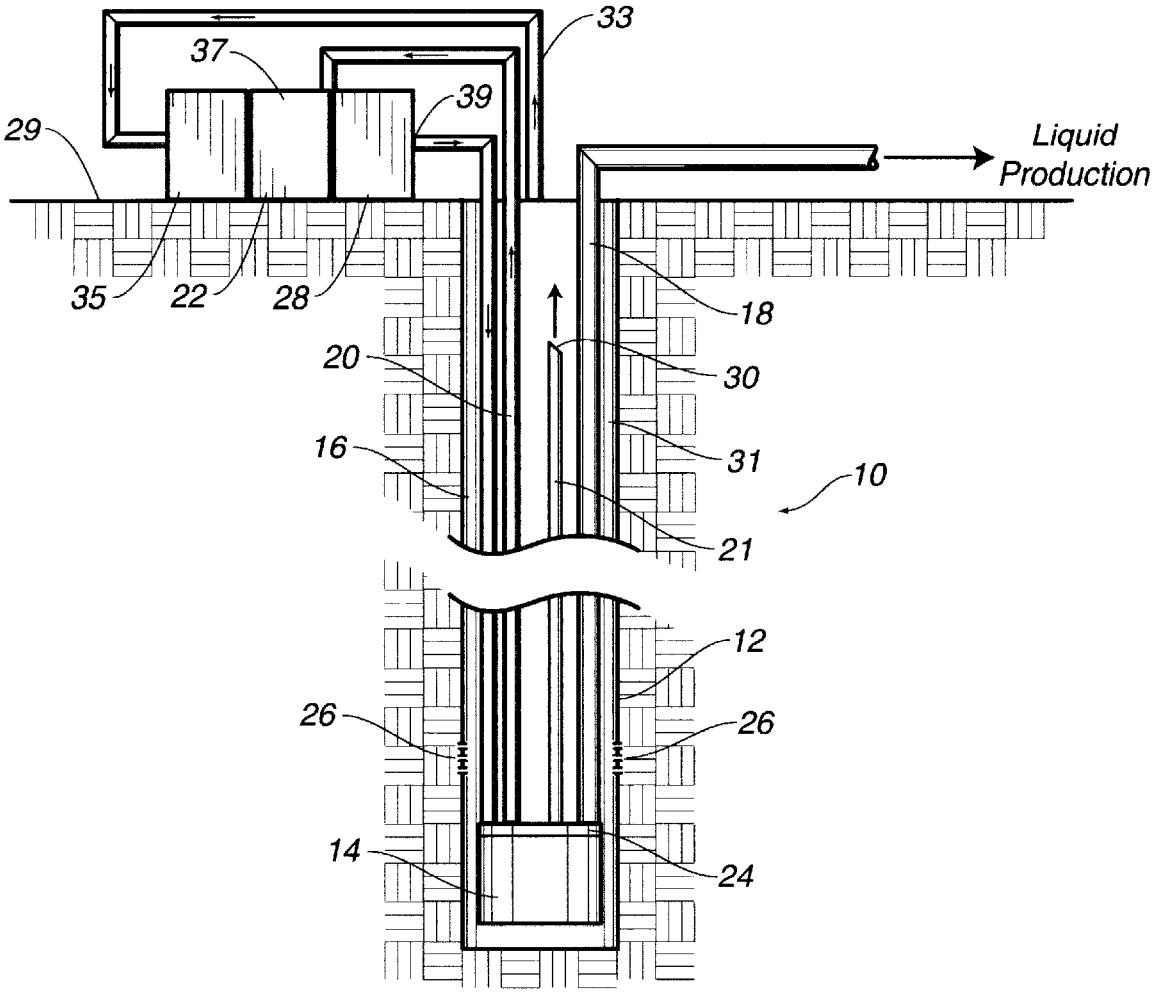
FIG. 1 is a diagrammatic cross-sectional view showing the configuration of the artificial lift system of the present invention.

Referring to FIG. 1, there is shown diagrammatically the artificial lift system 10 in accordance with the teachings of the present invention. The artificial lift system 10 is used for the extraction of oil, water and gas from the well bore 12. The artificial lift system 10 includes a chamber 14, a power gas string 16, a liquid string 18, a first vent stack 20, a second vent stack 21, and a multi-stage compressor 22. A suitable valving mechanism 24 is provided in association with the chamber 14. The valving mechanism 24 will be described in greater detail in connection with the illustration of FIGS. 2 and 4.

It can be seen in FIG. 1 that the chamber 14 is located in the well bore 12 below perforations 26 that are formed in the well bore 12. The chamber 14 could also be positioned above the perforations 26 in the well bore 12. The perforations 26 can be associated with perforations that are formed in an existing casing or in an existing production tubing. The power gas string 16 will extend from the third stage 28 of multi-stage compressor 22 to the chamber 14. The valving mechanism 24 is interactively connected with the power gas string 16 so as to allow pressurized gas to enter the chamber and to cause any liquid in the chamber 14 to pass through an outlet in the chamber 14 and into the liquid string 18. Any liquids within the chamber 14 will enter the liquid string 18 in a continuous flow line along the liquid string 18. The liquid string 18 extends from the chamber 14 to the wellhead area 29. As such, liquid, such as oil, can be removed from the well bore 12. Vent stack 20 is illustrated as extending from the chamber 14. Vent stack 20 extends from chamber 14 so as to deliver spent pressurized gas through the well bore 12 and up and into the multi-stage compressor 22. In particular, the spent power gas delivered through vent stack 20 is delivered to the inlet of the third stage 28 of the multi-stage compressor 22. The second vent stack 21 extends from the chamber 14 and upwardly through well bore 12. The vent stack 21 should have a suitable height so that the outlet 30 of the vent stack 21 resides in a location above the perforations 26. The vent stack 21 does not have to extend to an above-earth location. As can be seen in FIG. 1, the vent stack 21 releases spent power gas into the annulus 31 of the casing of the well bore 12. The spent power gas from the annulus 31 passes through low pressure line 33 to the first stage 35 of multi-stage compressor 22.

In FIG. 1, the compressor 22 should be a compressor which can produce at least 5,000 p.s.i. of gas pressure. This relatively large amount of gas pressure is required so as to push the entire line of liquid from the chamber 14 in a continuous ungasified line through the liquid string 18. The valving mechanisms and the associated tubing should have a suitable integrity to withstand such pressures. The compressor 22 is a multi-stage compressor having first stage 35, second stage 37 and third stage 28. A multi-stage compressor, which is known in the art, simply causes the pressures to increase between the stages. For example, first stage 35 may have a suction pressure of 300 p.s.i.g., the second stage may have an inlet pressure of 800 p.s.i.g. and the third stage may have an inlet pressure of 2,200 p.s.i.g. The 5,000 p.s.i. of gas pressure emitted by compressor 22 passes from the outlet 39 of the third stage 28 into the power gas string 16.

Importantly, in the present invention, the power gas string 16, liquid string 18, and the vent stack 20 can be formed of coiled tubing. Such coiled tubing can be run in and pulled from the well together as siamese strings. This provides an enormous efficiency in the installation and removal of such power gas and liquid strings.

Figure 2:
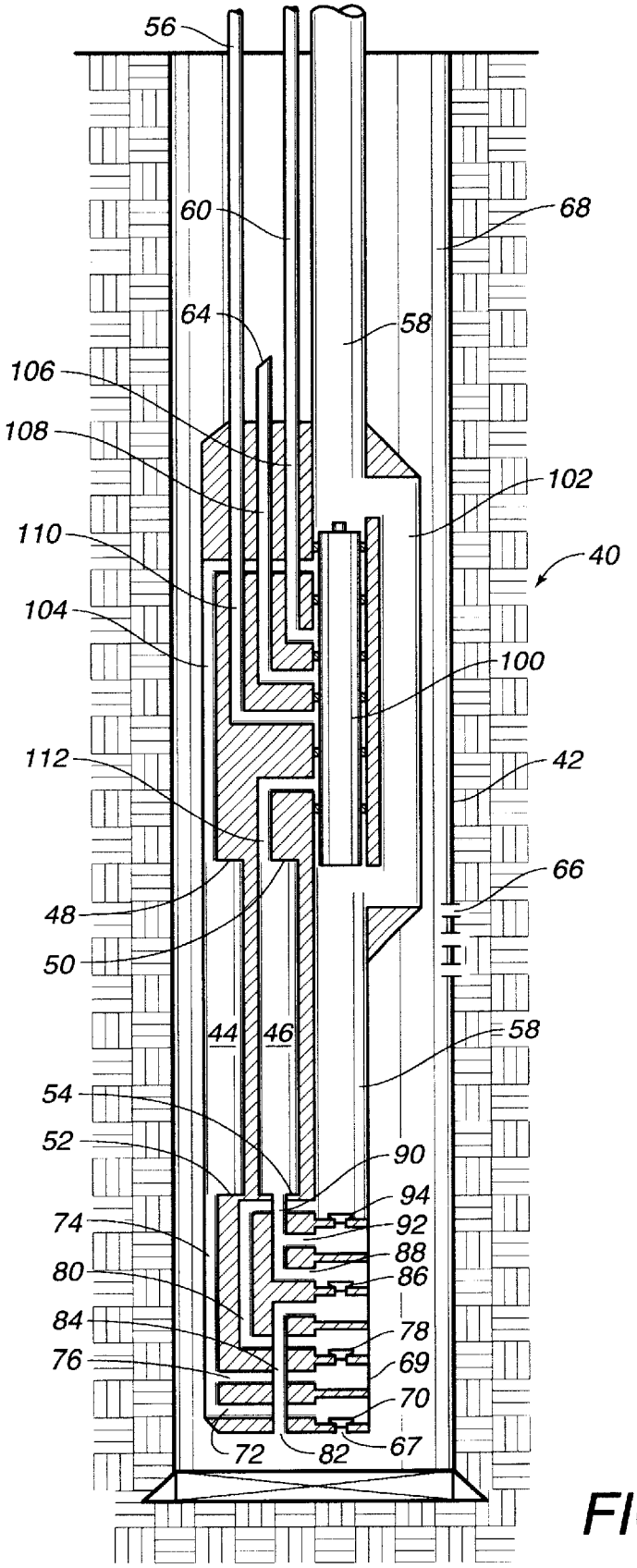
FIG. 2 is a cross-sectional view illustrating the preferred embodiment of the artificial lift system in accordance with the present invention.

FIG. 2 shows the preferred embodiment of the artificial lift system 40 of the present invention. The artificial lift system 40 is located in a well bore 42. In this embodiment 40 of the present invention, a first chamber 44 is positioned within the well bore 42 adjacent to a second chamber 46. The chambers 44 and 46 have approximately the same volume or capacity. The chambers 44 and 46 are arranged in side-by-side and parallel relationship. As can be seen, the top 48 of chamber 44 is aligned in the same horizontal plane with the top 50 of chamber 46. Similarly, the bottom 52 of chamber 44 is located in the same horizontal plane with the bottom 54 of chamber 46. It has been found that this side-by-side relationship of the chambers 44 and 46 can be more easily installed within the well bore without undue mechanical manipulation or structural engineering. Furthermore, the positioning of the chambers 44 and 46, at approximately the same location within the well bore avoids any differences in the loading of the chambers 44 and 46 because of the head pressure within the well. The arrangement of the chambers 44 and 46 in the side-by-side spaced relationship facilitates the automatic and continual cycling of the artificial lift system 40 without uneven liquid accumulation within the chambers 44 and 46.

As can be seen in FIG. 2, a power gas string 56 is arranged so as to be in valved communication with each of the chambers 44 and 46. A liquid string 58 also extends so as to be in valved communication with each of the chambers 44 and 46. A first vent stack 60 is further connected so as to be in valved communication with the chambers 44 and 46. The vent stack 60 extends through the well bore 42 so as to be connected with the compressor (as described herein previously in association with FIG. 1). A second vent stack 62 is also connected in valved communication with the chambers 44 and 46. The outlet 64 of the second vent stack 62 should be located above the perforations 66 in the casing of the well bore 42. As such, the vent 62 is suitable for venting gas into the annulus 68 of the well bore 42.

So as to allow the liquids from the annulus 68 of the well bore 42 to enter the chambers 44 and 46, a series of passageways and check valves are provided. Chamber 44 has an inlet 66 located at bottom of the bottom packing 69 of the system 40. A check valve 70 is affixed over inlet 67. As such, liquid from the annulus 68 will be free to enter the passageway 72 through the inlet 67 and the check valve 70. This liquid will flow through passageway 72, through passageway 74 and into the interior of the first chamber 44. During the injection of pressurized gas from the power gas string 56 into the chamber 44, any liquids on the interior of the chamber 44 will exit through passageway 74, through passageway 76, through check valve 78, through passageway 80 and into the liquid string 58. Similarly, liquids will be able to enter the second chamber 46 through the inlet 82 located at the bottom of the bottom packing 69. The liquid will enter inlet 82 and flow through passageway 84, through check valve 86, through passageway 88, through passageway 90 and into the interior of chamber 46. Check valve 86 will assure that liquids do not flow downwardly through chamber 46 and outwardly through the inlet 82. During the injection of pressurized gas from the power gas string 56, any liquids within chamber 46 will flow outwardly therefrom and into the liquid string 58 through passageway 90, through passageway 32 and outwardly into the liquid string 58 through check valve 94. Check valve 94 will assure that the liquids in the liquid string 58 do not flow backwardly into the second chamber 46. A shifting valve 100 is provided so as to have an action similar to that described herein previously. Although a shifting valve can have any number of configurations, the technology for the formation of shifting valve 100 is readily available. The shifting valve 100 should be wireline retrievable from the surface. Unlike the parent application to the present application, shifting valve 100 is placed directly in the liquid string 58 rather than in a side pocket mandrel. Upon experimentation, it was found that the space requirements for the shifting valve 100 can be greatly increased if the shifting valve 100 is placed directly in the liquid string 58. It can be seen that a bypass 102 is formed in the liquid string 58 so as to assure that the liquids will flow continuously therethrough. The placement of the shifting valve 100 within the liquid string 58 will allow a shifting valve having a diameter of 2¼ inches to be used rather than the 1¼ inch diameter shifting valve required when used in the side pocket mandrel.

In its simplest form, the shifting valve 100 is movable between two positions. When the shifting valve 100 is in its first position, it connects the power gas string 56 to connect to the first chamber 44 through passageway 104. In the same position, passageways 106 and 108 are blocked from communication with the chamber 44. When the shifting valve 100 is in this first position, it connects passageways 106 and 108 of vent stacks 60 and 62, respectively, with the second chamber 46. As such, the valve will operate so as to vent any pressurized gases through passageways 106 and 108 from chamber 46. In this position, passageway 110 of the power gas string 56 is blocked from passageway 112 associated with the second chamber 46. This will prevent chamber 46 from connecting to the power gas string 56. When the shifting valve is in this first position, power gas will displace any liquids in the chamber 44 and into the liquid string 58. Chamber 46 will depressurize and allow any gases to flow therefrom into the vent stacks 60 and 62. Simultaneously, chamber 46 will begin to be filled with liquid from the annulus 68 of the well bore 42.

When the shifting valve 100 switches to a second position, the connections are reversed. In other words, chamber 44 will communicate with the vent stacks 60 and 62 through passageways 104, 106 and 108. Chamber 46 will communicate with the power gas string 56 through passageways 110 and 112. In this manner, the present invention is able to achieve simultaneous displacement of one chamber while the other chamber is being depressurized and refilled. It is believed that this double chamber configuration can lift twice as much liquid as a single chamber arrangement. Production capacity is not interfered with since at least one of the chambers 44 and 46 will be continuously receiving liquid from the annulus 68 through respective inlets 67 and 82. This arrangement allows continuous cycling of the various components rather than the on/off arrangement associated with a single chamber arrangement.

Within the concept of the present invention, it is to be noted that the shifting valve 100 can move to other positions, if desired. Under certain circumstances, it may be desirable that the pressurized gas accumulate within the power gas string 56 before being introduced into either of the chambers 44 and 46. As such, the shifting valve 100 can move to a third position in which pressurized gas flow is blocked from entering either of chambers 44 and 46. In such an arrangement, the chambers 44 and 46 can simultaneously vent to the atmosphere or be filled with liquid from the annulus 68. Another position of the shifting valve 66 would have chambers 44 and 46 communicating with each other and not in communication with vent stacks 62 and 64 nor the power gas string 58. This position of the shifting valve 66 would allow the flow from one chamber to the other. This position of the shifting valve 66 might occur at the point in the lift cycle in which one chamber had completed the displacement of liquids into the liquid string 60 (filled with power gas) and the other chamber had been vented and filled with liquids from the annulus 70. The flow of gas from the just displaced chamber would "precharge" the liquid filled chamber with high pressure gas and thus raise the pressure in said liquid filled chamber. This precharge would reduce the volume of power gas that would be required to raise the pressure in the liquid filled chamber to the pressure required to displace liquids from the chamber to the liquid string 60. The precharge stage will reduce the energy requirements of the system and thus make it more efficient.

It is also important to note that the valve 100 can be constructed so as to assure that a first pressure of vented gas from the chambers 44 and 46 will pass through vent stack 60 and that a second range of pressures of vented gases from the chambers 44 and 46 will pass through vent stack 62 into the annulus 68. In order to achieve the efficiencies of the present invention, the shifting valve 100 should move, in such a manner, that vented gases of greater than 2,500 p.s.i. are delivered, initially, into the vent stack 60 for delivery to the third stage of the compressor 22. When the pressures have diminished to a certain level, the shifting valve 100 can move downwardly so as to assure that the gases with pressures of less than 2,500 p.s.i. or vented to the annulus 68. Although this valving arrangement associated with the vent stacks 60 and 62 can be carried out by the shifting valve 100, it is also possible to carry out such shifting at the surface, as associated with a single vent stack, or otherwise within the well bore 42. In other words, a valve can be used so as to shift gas flow from one vent to the other when the pressure of the gas within the particular vent has increased to the desired range of pressure. It is to be noted that when the shifting valve 100 initially shifts, then very high pressure gases from the respective chambers 44 and 46 are initially released. This initial release of pressure should be passed into the vent stack 60. The residual pressure release should go through the second vent stack 62. As such, rather than being pressure-based, the shifting valve 100 can be responsive to timing.

Figure 3:
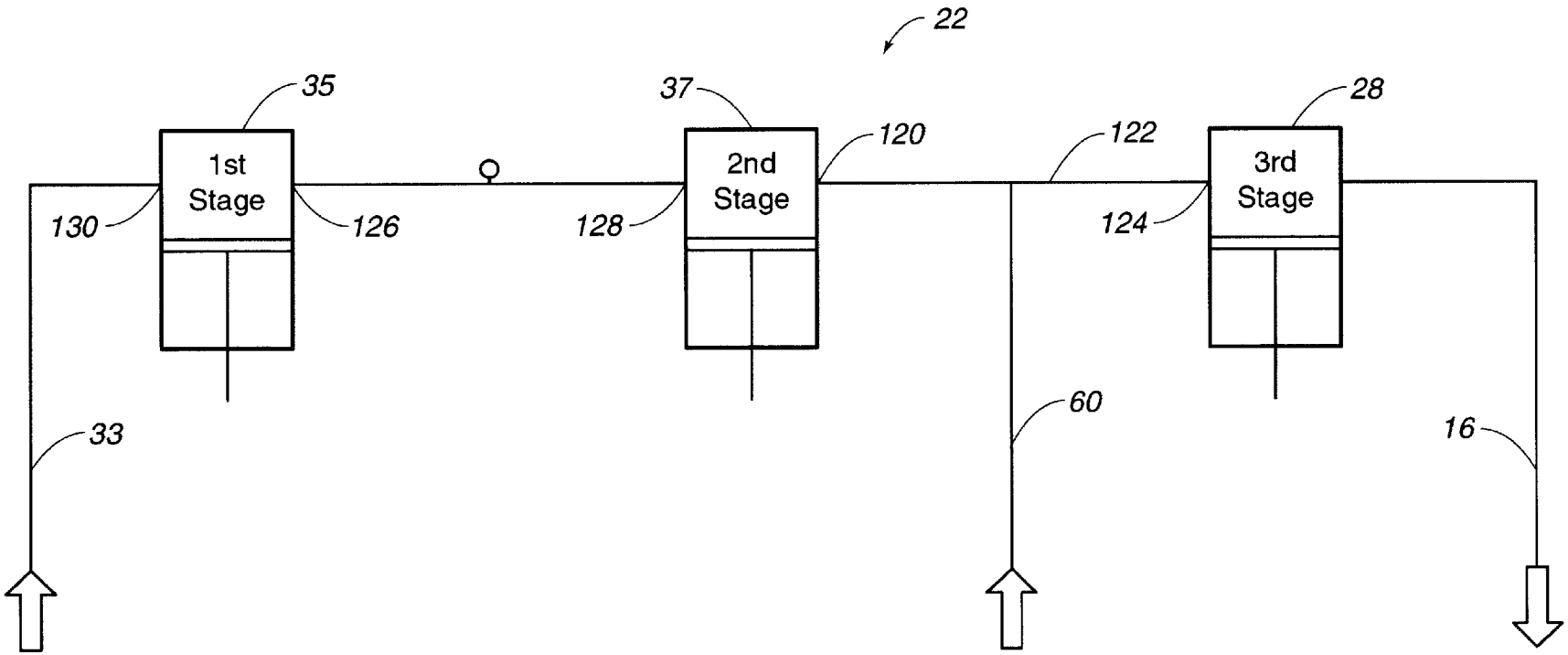
FIG. 3 is a diagrammatic illustration of the arrangement of the multi-stage compressor.

FIG. 3 diagrammatically illustrates the configuration of the compressor 22. It can be seen that in FIG. 3 that the compressor 22 has a first stage 35, a second stage 37, and a third stage 28. The third stage 28 is connected so as to deliver pressurized gas of greater than 5,000 p.s.i. to the power gas string 16 and ultimately to the chambers within the artificial lift system 10 of the present invention. The third stage 28 will receive, at its suction side, the pressurized gases emitted from the outlet 120 of the second stage 37. These pressurized gases will pass along line 122 into the suction side 124 of the third stage 28. Additional pressurized gases will be received from the vent stack 60. As such, the present invention conserves pressure requirements by introducing such pressures at the area between the second stage 37 and the third stage 28, or, as stated otherwise, to the inlet (or suction side 124) of the third stage 28.

The first stage 35 has its outlet 126 delivering pressure to the suction side 128 of the second stage 37. The first stage 35 has its inlet (or suction side) 130 connected to conduit 33. Conduit 33 is connected to the casing annulus so as to draw the residual pressure from the interior of the well bore 12. As such, gases emitted by the second vent stack 62 can be introduced to the first stage 35 of the multi-stage compressor 22.

An analysis conducted of the present invention revealed that the present invention greatly diminishes horse power requirements while improving lifting efficiency. The empirical data as shown on the following table:

from 40% to 63%. In order to do this, the pressure in the chamber would have to be reduced from the initial pressure of 6,190 p.s.i. to 2,500 p.s.i. by flowing this volume of gas up the vent stack 60 to the third stage 28 of the compressor 22. This improvement in efficiency is dramatic and is applicable to both single and double chamber systems.

Figure 4:
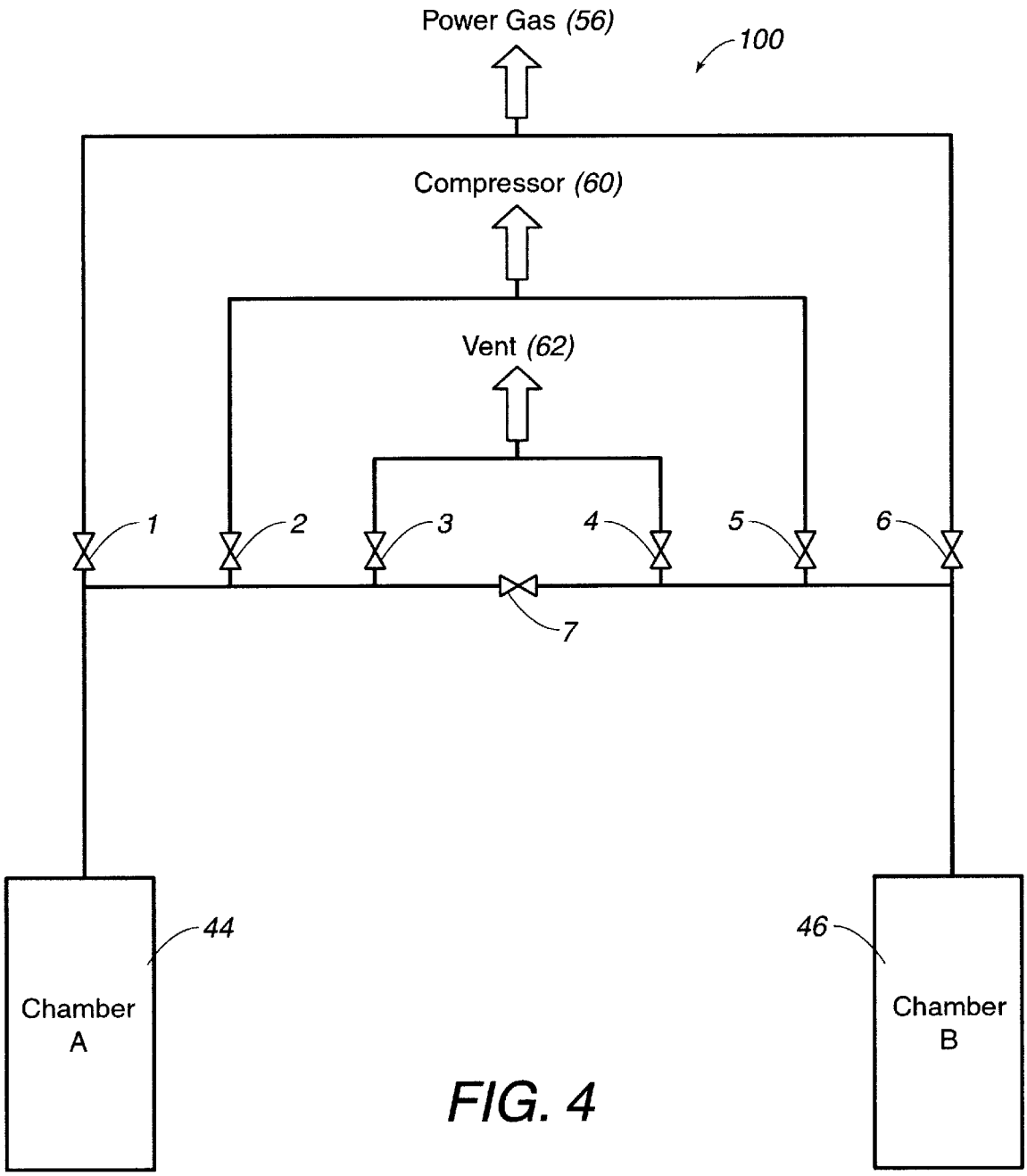
FIG. 4 is a flow diagram showing the operation of the shifting valve in association with the preferred embodiment of the present invention.

FIG. 4 illustrates diagrammatically the operation of the shifting valve 100 and how it operates so as to pass the gases from and into the system. The table, as follows, describes the operation of the shifting valve, or valves, associated with the operation of the present invention.

TABLE I

MULTISTAGE VENT SYSTEM FOR GAS DISPLACED CHAMBER LIFT

TUBULARS: LIQUID STRING - 2⅞", POWER GAS STRING - 1¾", SPENT POWER GAS STRING - 1¾",CASING - 7"
DEPTH: 15,000 FT
FORMATION FLUID: 2000 BPD, 50% OIL/50% WATER, FLR - 100 SCF/BBL, OIL API - 50, WATER SG - 1.2, GAS SG - 0.65
POWER GAS: 90/5/3/1/0.5/0.3/0.2, K - 1.29, SG - 0.645, MW - 18.693, 22.29 SCF/LB
TEMPERATURES: BOTTOMHOLE FLOWING - 320 DEG F., WELLHEAD FLOWING TEMP - 275 DEG F.
PRESSURES: FWHP - 300 PSIG
CHAMBER: ASSUME 1 BBL CHAMBER SIZE

| | | | FLOWRATE UP SPENT PGS | | FLOW DATA WHEN STARTING @ 6190 PSI (800/2200) | | | COMPRESSION REQUIREMENTS | | LIFTING EFFICIENCY | |
|---|---|---|---|---|---|---|---|---|---|---|---|
| CONDITIONS AT CHAMBER | | | 800 PSI | 2200 PSI | CUM AVG | | FLOW | 800 PSI | 2200 PSI | 800 PSI | 2200 PSI |
| PRESS (PSIG) | DENSITY (PPG) | SCF GAS (SCF) | SUCTION (SCFM) | SUCTION (SCFM) | FLOW RT (SCFM) | CUM VOL (SCF) | TIME (SEC) | SUCTION (BHP) | SUCTION (BHP) | SUCTION (%) | SUCTION (%) |
| 6190* | 1.65 | 1545 | 4953 | 4474 | 4953/4474 | 0/0 | — | 540 | 540 | 40 | 40 |
| 5500 | 1.52 | 1423 | 4409 | 3855 | 4681/4165 | 122/122 | 1.6/1.8 | 514 | 501 | 42 | 43 |
| 5000 | 1.42 | 1329 | 4005 | 3383 | 4456/3904 | 216/216 | 2.9/3.3 | 504 | 479 | 43 | 45 |
| 4500 | 1.31 | 1226 | 3597 | 2881 | 4241/3648 | 319/319 | 4.5/5.2 | 492 | 456 | 44 | 47 |
| 4000 | 1.19 | 1114 | 3181 | 2330 | 4029/3385 | 431/431 | 6.4/7.6 | 479 | 430 | 45 | 50 |
| 3500 | 1.06 | 992 | 2757 | 1708 | 3817/3105 | 553/553 | 8.7/10.7 | 466 | 403 | 46 | 54 |
| 3000 | 0.93 | 871 | 2324 | 844 | 3603/2782 | 674/674 | 11.2/14.5 | 452 | 375 | 48 | 58 |
| 2500 | 0.78 | 730 | 1880 | 71 | 3388/2443 | 815/815 | 14.4/20.0 | 435 | 343 | 50 | 63 |
| 2000 | 0.63 | 590 | 1414 | 0 | 3169/— | 955/815 | 18.1/— | 420 | — | 51 | — |
| 1500 | 0.47 | 440 | 896 | 0 | 2942/— | 1105/815 | 22.5/— | 402 | — | 54 | — |

*CONDITIONS IN CHAMBER AT THE TIME VENTING STAGE BEGINS

According to the data shown on the attached sheet, it can be seen that the use of the multi-stage vent system of the present invention reduces horse power from 540 horse power to 343 horse power. This increases lifting efficiency

TABLE II

DESCRIPTION OF LIFT CYCLE
GDCL-DOUBLE CHAMBER
PRECHARGE OF CHAMBERS & GAS LIFT ASSIST OR CLOSED LOOP/MULTISTAGE VENT

| | STATUS OF CHAMBERS | | POSITION OF VALVES | | | | | | |
|---|---|---|---|---|---|---|---|---|---|
| STAGE # | CHAMBER A | CHAMBER B | #1 | #2 | #3 | #4 | #5 | #6 | #7 |
| CYCLE BEGINS WITH CHAMBER A VENTED, REFILLED WITH LIQUID AND READY FOR DISPLACEMENT AND CHAMBER B HAVING BEEN DISPLACED AND READY FOR VENTING | | | | | | | | | |
| ONE | PRECHARGED BY CHAMB B | STEP 1 OF VENT-PRECHARGE CHAMB A | C | C | C | C | C | C | O |
| TWO | DISPLACTNG W/ POWER GAS | STEP 2 OF VENT-GAS LIFT ASSIST OR INTERSTAGE OF COMPRESSOR | O | C | C | C | O | C | C |
| THREE | DISPLACING W/ POWER GAS | STEP 3 OF VENT-VENT REMAINING GAS TO ANNULUS AND FILL CHAMB W/LIQUID | O | C | C | O | C | C | C |
| FOUR | STEP 1 OF VENT- | PRECHARGED BY | C | C | C | C | C | C | O |

TABLE II-continued

| DESCRIPTION OF LIFT CYCLE GDCL-DOUBLE CHAMBER PRECHARGE OF CHAMBERS & GAS LIFT ASSIST OR CLOSED LOOP/MULTISTAGE VENT | | | | | | | | | |
|---|---|---|---|---|---|---|---|---|---|
| | STATUS OF CHAMBERS | | POSITION OF VALVES | | | | | | |
| STAGE # | CHAMBER A | CHAMBER B | #1 | #2 | #3 | #4 | #5 | #6 | #7 |
| | PRECHARGE CHAMB B | CHAMB A | | | | | | | |
| FIVE | STEP 2 OF VENT-GAS LIFT ASSIST OR INTERSTAGE OF COMPRESSOR | DISPLACING W/ POWER GAS | C | O | C | C | C | O | C |
| SIX | STEP 3 OF VENT-VENT REMAINING GAS TO ANNULUS AND FILL CHAMB W/LIQUID | DISPLACING W/ POWER GAS | C | C | O | C | C | O | C |

As stated herein previously, the present invention achieves enormous energy and economic efficiencies by reducing the power requirements of the compressor. By utilizing the high pressure gas already introduced into the chambers, the horse power requirements of the compressor are greatly reduced. By introducing the high pressure gas into the third stage and the lower pressure gas into the first stage, the compressor has to work less to produce the high pressure (greater than 5,000 p.s.i.) required for the evacuation of the respective chambers of liquid. Additionally, since the same gas is used that was introduced into the respective chambers for the evacuation of the liquid therefrom, the gases used for the operation of the present invention are effectively conserved and reused. This is particularly important if spectral gases are used for the operation of the present invention. For example, in many well operations, inert gases are used so as to avoid corrosion of the downhole equipment. These inert gases can be expensive to use. If such expensive gases are used, then the operation of the present invention can effectively conserve such gases and reduce costs associated with the provision of such gases.

The artificial lift system of the present invention is particularly useful for restoring production in depleted high condensate yield sour gas wells. In particular, this system can be applied to Smackover wells. The present invention achieves flowing bottom hole pressures of approximately 600 p.s.i. at 13,000 feet with flowing wellhead pressures of 300 p.s.i. The configuration of the present invention employs an apparatus that can withstand bottomhole temperatures of greater than 300° F. The present system can handle produced gas volumes of 3,000 MCFD. The present invention can achieve the production of liquid volumes exceeding 500 barrels per day. The present invention is suitable for operating in a very "gassy" high API oil gravity environment. Since the wells in which the present invention are intended to be used for producing in sour gas environments, the present invention minimizes the downhole, parts. As a result, the present invention avoids the destructive effects of the corrosive environment into which it is placed. The downhole moving parts are wireline retrievable. The present invention can work with saturated brines having greater than 200,000 parts per million chlorides. The present invention is compatible with conventionally-sized production casing. Despite the fact the present invention can be used at very deep volumes, the present invention is cost competitive with other forms of lift. It is possible that the present invention can be utilized in depths of up to 25,000 feet and can lift higher volumes of up to 2,000 barrels per day. Unlike intermittent systems, the present invention pushes an entire line of liquid through the liquid string. As such, the transit time of individual "slugs" of liquid is avoided. The liquid string continuously allows the outflow of liquid therefrom. The ability to control and utilize high gas pressures allows for the necessary "brute" force so as to deliver the continuous string of liquid from the liquid string.

The foregoing disclosure and description of the invention is illustrative and explanatory thereof. Various changes in the details of the illustrated construction or in the steps of the described method can be made within the scope of the appended claims without departing from the true spirit of the invention. The present invention should only be limited by the following claims and their legal equivalents.

I claim:

1. An artificial lift system for use in a well bore comprising:

at least one chamber having an inlet and an outlet;

a power gas string in valved communication with said chamber;

a liquid string in valved communication with said outlet of said chamber;

a first vent in valved communication with each said chamber;

a second vent in valved communication with each said chamber;

a compressor connected to said power gas string and adapted to pass a pressurized gas into said power gas string, said first vent connected to said compressor and adapted to pass vented gas of a first pressure range from said chamber into said compressor, said second vent adapted to pass vented gas of a second pressure range into the well bore; and a valve connected to said power gas string and to said chamber, said valve adapted to selectively allow the pressurized gas to enter said chamber so as to cause a liquid in said chamber to pass through said outlet of said chamber and into said liquid string.

2. The system of claim 1, said first pressure range being greater than said second pressure range.

3. The system of claim 1, said compressor being a multi-stage compressor, said vent being connected to one stage of said compressor.

4. The system of claim 1, said first pressure range being pressures of greater than 2,500 p.s.i.

5. The system of claim 1, further comprising:

a casing through which said chamber and said power gas string and said liquid string and said first and second vents extend, said casing having an annulus, said second vent adapted to pass the vented gas of the second pressure range into said annulus.

6. The system of claim 5, said compressor having a first stage, a second stage and a third stage, said third stage connected to said power gas string, said first vent connected to said compressor between said second and third stages, said annulus connected to an inlet of said first stage such that the vented gas of the second pressure range passes into said compressor at said first stage.

7. The system of claim 1, said compressor adapted to pass a pressurized gas of greater than 5,000 p.s.i. into said power gas string.

8. The system of claim 1, said valve adapted to cause the liquid in the chamber to extend as a continuous liquid line in said liquid string.

9. An artificial lift system for use in a well bore comprising:

at least one chamber having an inlet and an outlet;

a power gas string in valved communication with said chamber;

a liquid string in valved communication with said outlet of said chamber;

at least one vent in valved communication with said chamber, said vent adapted to pass a vented gas from said chamber;

a compressor connected to said power gas string and adapted to pass a pressurized gas into said power gas string, said vent connected to said compressor and adapted to pass the vented gas into said compressor, said compressor having a first stage and a second stage and a third stage, said third stage connected to said power gas string, said vent connected to an inlet of said third stage; and a valve connected to said power gas string and to said chamber, said valve adapted to selectively allow the pressurized gas to enter said chamber so as to cause a liquid in said chamber to pass through said outlet of said chamber and into said liquid string.

10. An artificial lift system for use in a well bore comprising:

a first chamber having an inlet and an outlet;

a second chamber having an inlet and an outlet, said second chamber being arranged in parallel relation to said first chamber, said first chamber having a top end aligned in a horizontal plane with a top of said second chamber, said first chamber having a bottom end aligned in a horizontal plane with a bottom of said second chamber;

a power gas string in valved communication with said first chamber and said second chamber;

a liquid string in valved communication with said outlet of said first chamber and with said outlet of said second chamber;

at least one vent in valved communication with said first chamber and with said second chamber said vent adapted to pass a vented gas from said first and second chambers;

a compressor connected to said power gas string and adapted to pass a pressurized gas into said power gas string said vent connected to said compressor and adapted to pass the vented gas into said compressor; and a valve connected to said power gas string and to said first and second chambers said valve adapted to selectively allow the pressurized gas to enter said first and second chambers so as to cause a liquid in said first and second chambers to pass through the respective outlets of said first and second chambers and into said liquid string.

11. The system of claim 10, said first chamber arranged in spaced and separate relationship to said second chamber, said first chamber having an approximately equal volume of said second chamber.

12. An artificial lift system for use in a well bore comprising:

a first chamber having an inlet and an outlet;

a second chamber having an inlet and an outlet, said second chamber arranged in parallel relation to said first chamber;

a power gas string in valved communication with said first and second chambers;

a liquid string in valved communication with said outlet of said first chamber and with said outlet of said second chamber;

a first vent connected to said compressor and adapted to pass vented gas of a first pressure range from said first and second chambers into said compressor;

a second vent adapted to pass vented gas of a second pressure range from said first and second chambers;

a compressor connected to said power gas string and adapted to pass a pressurized gas into said power gas string;

a valve connected to said power gas string and to said first and second chambers, said valve adapted to selectively allow the pressurized gas to enter said first and second chambers so as to cause a liquid in said first and second chambers to pass through the respective outlets of said first and second chambers and into said liquid string, said valve movable between a first position and a second position, said first position allowing pressurized gas into one of said first and second chambers while blocking pressurized gas from entering another of said first and second chambers, said second position allowing pressurized gas into said another of said first and second chambers while blocking pressurized gas from entering said one of said first and second chamber, said valve adapted to switch between said first and second vents relative to a pressure of the vented gas.

13. An artificial lift system for use in a well bore comprising:

at least one chamber having an inlet and an outlet;

a power gas string in valved communication with said chamber;

a liquid string in valved communication with said outlet of said chamber;

a multi-stage compressor connected to said power gas string and adapted to pass a pressurized gas of greater than 5,000 p.s.i. into said power gas string;

a first vent in valved communication with each said chamber, said first vent connected to said multi-stage compressor and adapted to pass vented gas of a first pressure range from each said chamber and into said multi-stage compressor;

a second vent in valved communication with each said chamber, said second vent adapted to pass vented gas of a second pressure range from each said chamber; and a valve connected to said power gas string and to said chamber, said valve adapted to selectively allow the pressurized gas to enter said chamber so as to cause a liquid in said chamber to pass through said outlet of said chamber and into said liquid string.

14. The system of claim 13, said multi-stage compressor having a first stage, a second stage, and a third stage, said third stage having an outlet connected to said power gas string, said first vent connected to an inlet of said third stage, said first pressure range being pressures greater than 2,500 p.s.i.

15. The system of claim 14, further comprising:

a casing through which said chamber and said power gas string and said liquid string and said first and second vents extend, said casing having an annulus, said second vent adapted to pass the vented gas of the second pressure range into said annulus, said annulus being connected to an inlet of said first stage, said second pressure range being pressures of less than said first pressure range.

* * * * *